US009221582B2

(12) United States Patent
Wheeler et al.

(10) Patent No.: US 9,221,582 B2
(45) Date of Patent: Dec. 29, 2015

(54) COLLAPSIBLE CONTAINER

(71) Applicant: LIFETIME BRANDS, INC., Garden City, NY (US)

(72) Inventors: Jasper E. Wheeler, Brooklyn, NY (US); Reid Hecker, Lake Ronkonkoma, NY (US)

(73) Assignee: LIFETIME BRANDS, INC., Garden City, NY (US)

( * ) Notice: Subject to any disclaimer, the term of this patent is extended or adjusted under 35 U.S.C. 154(b) by 92 days.

(21) Appl. No.: 14/036,645

(22) Filed: Sep. 25, 2013

(65) Prior Publication Data

US 2015/0083736 A1 Mar. 26, 2015

(51) Int. Cl.
*B65D 21/08* (2006.01)

(52) U.S. Cl.
CPC ..... *B65D 21/086* (2013.01)

(58) Field of Classification Search
CPC ..... B65D 21/086
USPC ..... 220/8, 666, 6, 574, 675, 672, 359.1, 220/269; 215/900, 232
See application file for complete search history.

(56) References Cited

U.S. PATENT DOCUMENTS 2,880,902 A * 4/1959 Owsen ..... 220/8
3,173,573 A * 3/1965 Donegan ..... B65D 1/32 220/495.02
4,875,576 A 10/1989 Torgrimson et al.
5,439,128 A 8/1995 Fishman
5,860,556 A 1/1999 Robbins, III
5,900,293 A 5/1999 Zettle
5,911,338 A 6/1999 Miller
6,103,116 A 8/2000 Koslow et al.
6,315,151 B1 11/2001 Hupp et al.
6,736,285 B2 5/2004 Stewart-Stand
7,654,402 B2 2/2010 Kusuma et al.
7,678,271 B2 3/2010 Curtin
8,317,046 B2 11/2012 Vanderberg et al.
8,560,031 B2 * 10/2013 Barnett et al. ..... 455/575.8
2010/0133281 A1 * 6/2010 Wojcik ..... B65D 83/0055 220/666
2011/0284547 A1 * 11/2011 McElligott et al. ..... 220/495.03
2013/0075393 A1 3/2013 Haynie
2013/0277364 A1 * 10/2013 Kusuma et al. ..... 220/8

* cited by examiner

*Primary Examiner* — Robert J Hicks
*Assistant Examiner* — Kareen Thomas
(74) *Attorney, Agent, or Firm* — Tutunjian & Bitetto, P.C.

(57) ABSTRACT

A collapsible container is provided. The collapsible container includes a substantially rigid upper rim, and a container portion that is made entirely of a flexible (collapsible) material. The flexible container has a base and side walls extending upward from the base. The side walls include at least one living hinge, and the base is formed with a structural ribbing configuration. The structural ribbing integrated into the base and formed of the flexible material creates a level of rigidity in the same that allows the entire container to collapse and extend without requirement any other materials incorporated into the container portion.

16 Claims, 6 Drawing Sheets

COLLAPSIBLE CONTAINER

BACKGROUND

1. Technical Field

The present principles relate to containers. More particularly, it relates a collapsible container.

2. Related Art

Containers capable of safely containing an item or items are used for almost everything. Among the most common containers are those for food items. However, containers can be used for many other things such as storing clothing, and/or containing liquids of any kind.

The concept of a collapsible container has been introduced in an effort to save space in the storage of the actual containers. The available collapsible containers generally include a combination of hard or rigid materials and a softer material to enable the "collapsible" feature. One common feature for some known collapsible containers is the use of a rigid base and one or more rigid side wall members.

SUMMARY

According to an implementation, the collapsible container includes a substantially rigid upper rim, and a flexible container portion made of a flexible material. The flexible container has an upper opening for receiving and securing the substantially rigid upper rim. The flexible container further includes a base, side walls extending upward from said base and integrally formed therewith. The side walls have at least two living hinges separating said side walls into at least three sections. The base is thicker than the side walls, and is formed by the same flexible material as the side walls.

These and other aspects, features and advantages of the present principles will become apparent from the following detailed description of exemplary embodiments, which is to be read in connection with the accompanying drawings.

BRIEF DESCRIPTION OF THE DRAWINGS

The present principles may be better understood in accordance with the following exemplary figures, in which.

DETAILED DESCRIPTION

Figure 1:
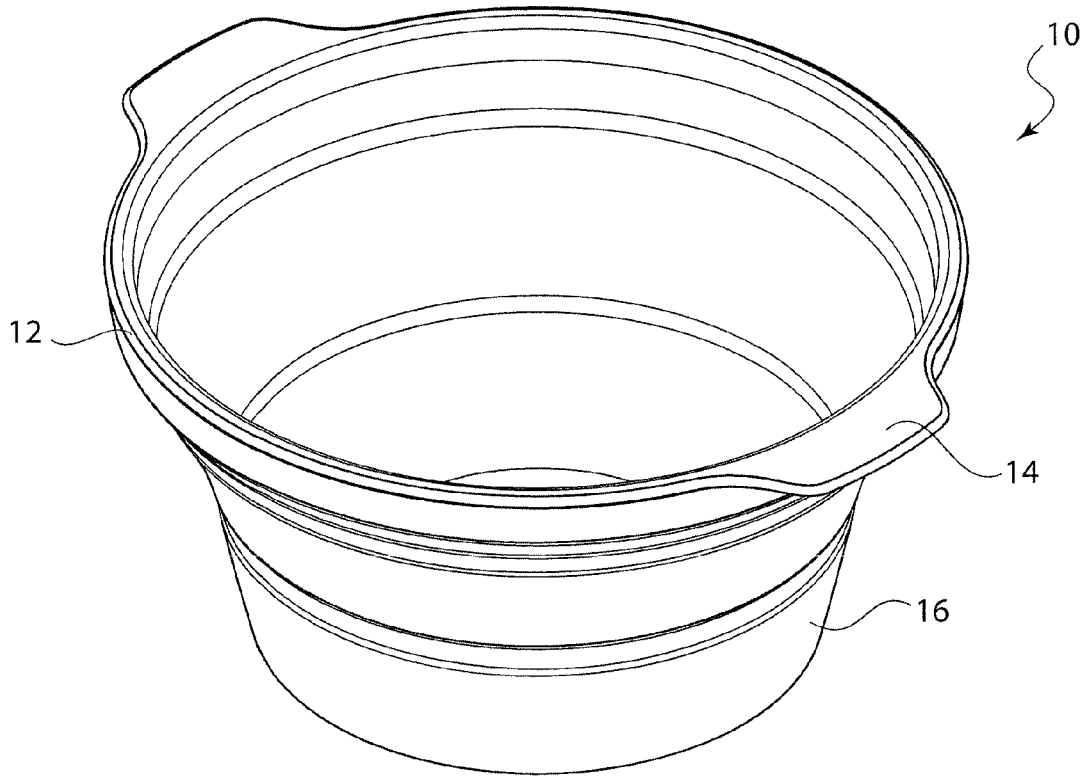
FIG. 1 is a perspective view of the collapsible container according to an implementation of the present principles.

The present principles are directed to an improved collapsible container being capable of being used for many different applications.

The present description illustrates the present principles. It will thus be appreciated that those skilled in the art will be able to devise various arrangements that, although not explicitly described or shown herein, embody the present principles and are included within its spirit and scope.

All examples and conditional language recited herein are intended for pedagogical purposes to aid the reader in understanding the present principles and the concepts contributed by the inventor(s) to furthering the art, and are to be construed as being without limitation to such specifically recited examples and conditions.

Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

For the purposes of promoting an understanding of the principles of the present disclosure, reference will now be made to the embodiments illustrated in the drawings, and specific language will be used to describe the same. It will nevertheless be understood that no limitation of the scope of the disclosure is intended. Any alterations and further modifications in the described devices, instruments, methods, and any further application of the principles of the disclosure as described herein are contemplated as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. Reference will now be made in detail to the exemplary embodiments of the present disclosure, which are illustrated in the accompanying figures.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "superior" and "inferior" are relative and used only in the context to the other, and are not necessarily "upper" and "lower".

Figure 2A:
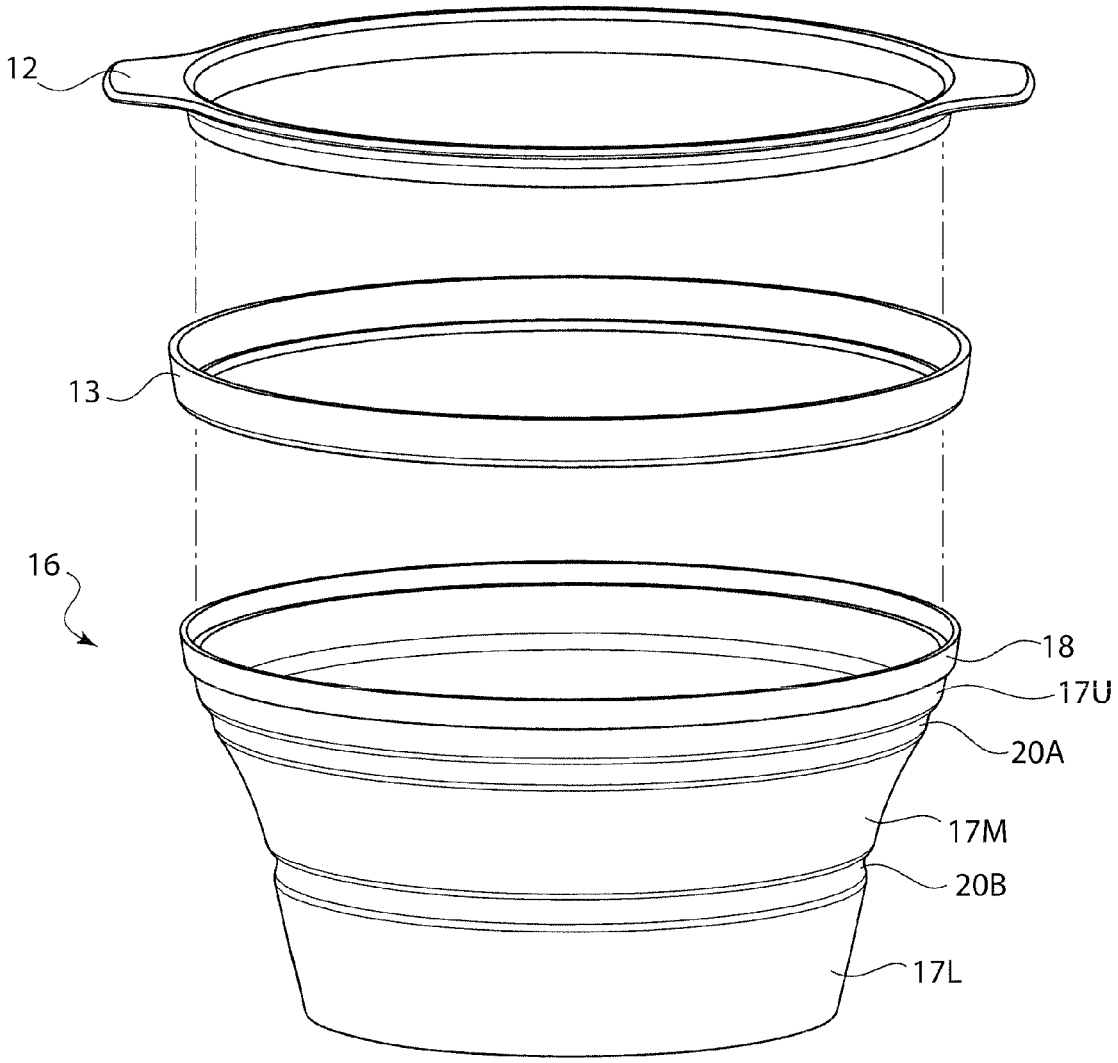
FIG. 2A is an exploded perspective view of the collapsible container according to an implementation of the present principles.

Referring to FIGS. 1 and 2A, there is shown the collapsible container 10 according to one implementation of the present principles. Container 10 includes an upper, substantially rigid rim 12 that may or may not include handles 14, and a lower flexible container portion 16. The flexible container 16 is entirely made up of a flexible material, and has a upper flexible "rim engaging" portion 18, and up to three side wall sections 17 separated by living hinges 20. The flexible container portion 16 can be fabricated using any flexible rubber material, such as, but not limited to a thermoplastic elastomer (TPE) and Silicone. The rigid rim 12 can be made of any rigid or semi-rigid material such as, but not limited to, Poly Propylene (PP), Acrylonitrile Butadiene Styrene (ABS), Nylon, Steel, Stainless Steel, Wood, etc. As such, when the term "substantially rigid" is used herein, it includes both rigid and semi-rigid materials.

Although shown in the disclosed embodiment as a round container, those of skill in the art will appreciate that the present principles disclosed herein can be applied to containers of various shapes. Examples of such shapes can be, but not limited to, square, hexagon, triangle, oval, or rectangle.

According to a preferred implementation of the flexible container 16, the upper section 17U is positioned between the flexible rim engaging portion 18 and the first living hinge 20A. A middle section 17M is positioned between the upper living hinge 20A and the lower living hinge 20B. The lower section 17L is below the lower living hinge 20B, and includes the base 22 which will be described in greater detail below.

In the example of FIG. 2A, the upper rim 12 and middle rim 13 cooperate to mechanically sandwich the upper flexible rim 18 there between, thus securing the upper rim 12 to the collapsible container 16. This mechanical connection is shown more clearly in the cross-sectional view of FIG. 4.

Figure 2B:
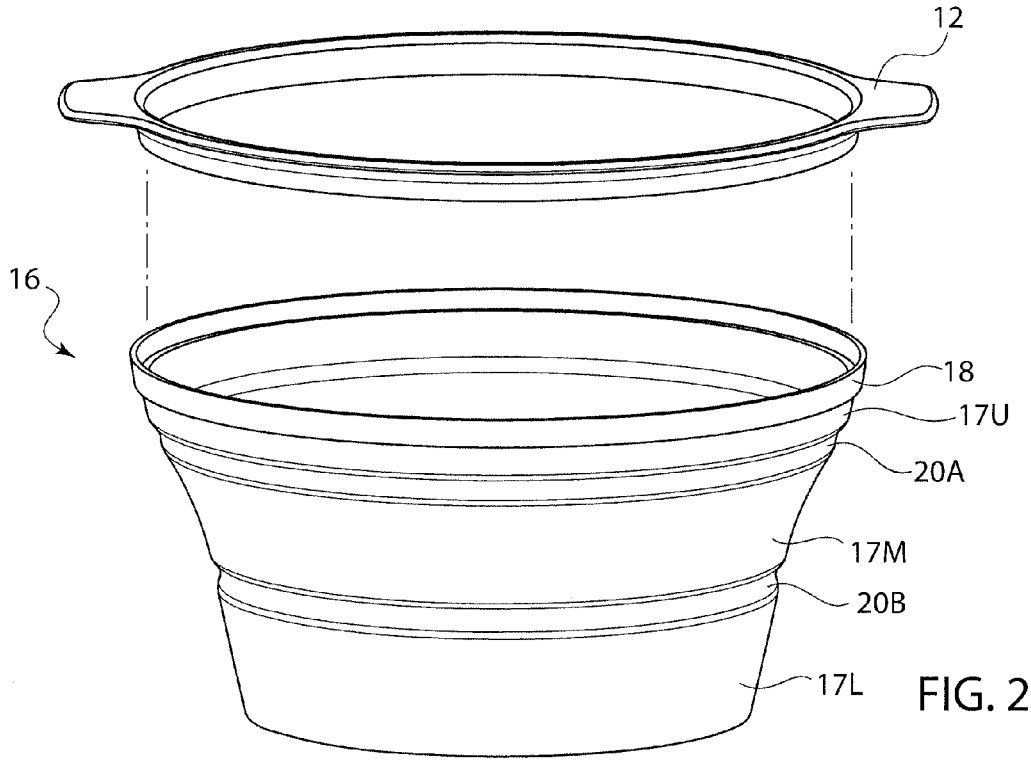
FIG. 2B is an exploded perspective view of the collapsible container according to another implementation of the present principles.

FIG. 2B shows another implementation of the collapsible container according to the present principles. In this implementation, the middle rim 13 is eliminated and the upper rim 12 is connected to the flexible container 16 using either an over-molding or a compression molding manufacturing process. Those of skill in the art will appreciate that the removal of the middle rim 13 would also eliminate the need for the upper flexible rim 18 of the flexible container.

Figure 3:
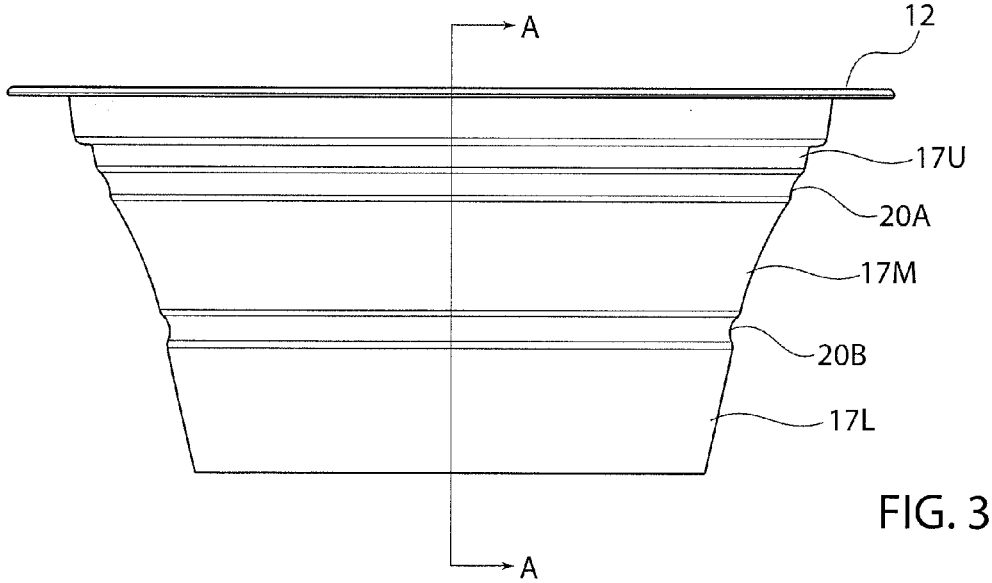
FIG. 3 is a side view of the collapsible container according to an implementation of the present principles.
Figure 4A:
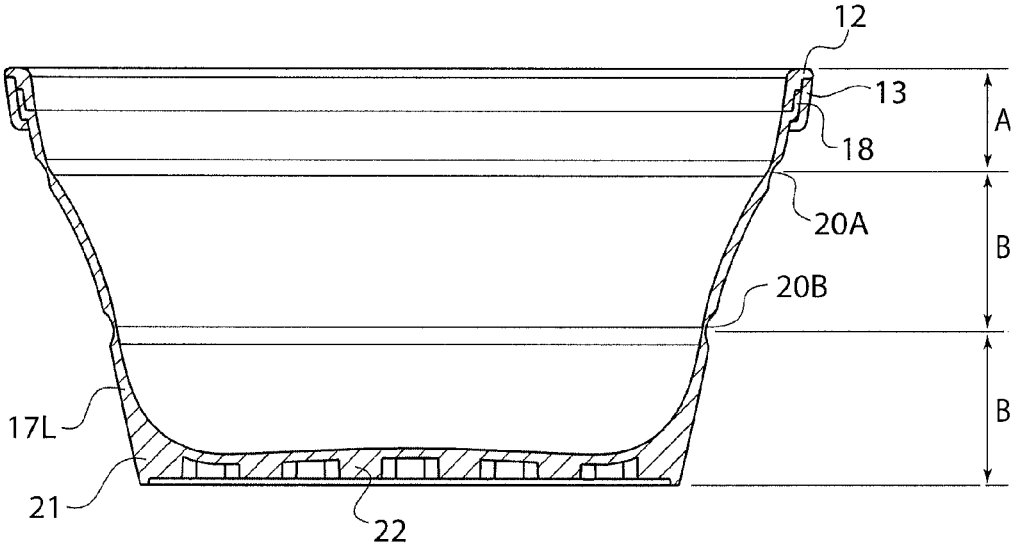
FIG. 4A is a cross-sectional view of the collapsible container of FIG. 3 taken along lines A-A, according to an implementation of the present principles.
Figure 4B:
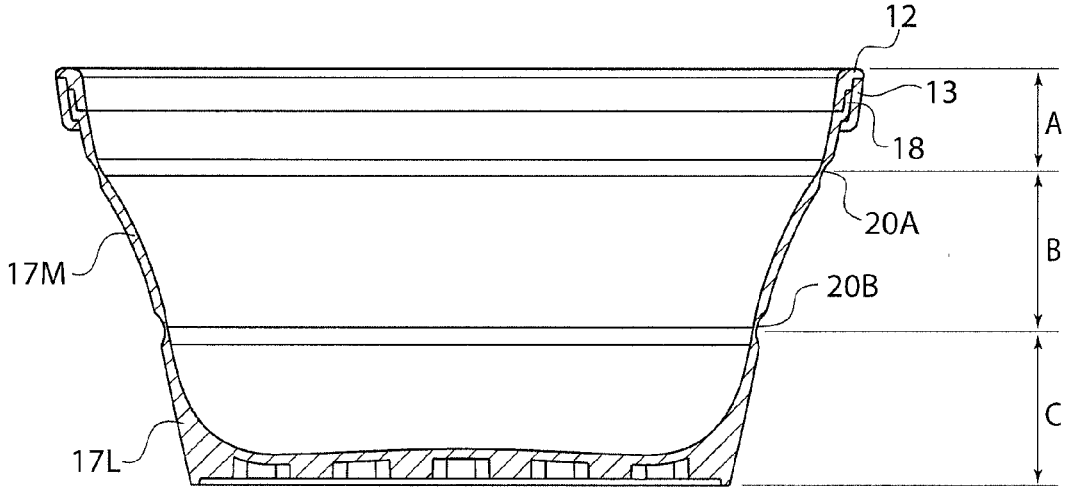
FIG. 4B is a cross-sectional view of the collapsible container according to another implementation of the present principles.

Referring to FIGS. 3, 4A and 4B, there is shown two implementations of the container 16 according to the present principles. In accordance with one implementation, (FIGS. 3 and 4A), the three sections 17 are not all the same size. In this embodiment, the upper section 17U is smaller (A) than the middle 17M and lower 17L sections which are the same size (B). In accordance with another implementation (FIG. 4B), the three sections 17 are all different sizes (A, B and C).

According to a preferred implementation, the container 16 does not have a rigid base and/or any rigid side members. However, as those of skill in the art will appreciate, an entirely flexible container configured to collapse, would not work without some form of rigid base incorporated therein. That is, prior to the creation of the collapsible container disclosed herein.

Figure 5:
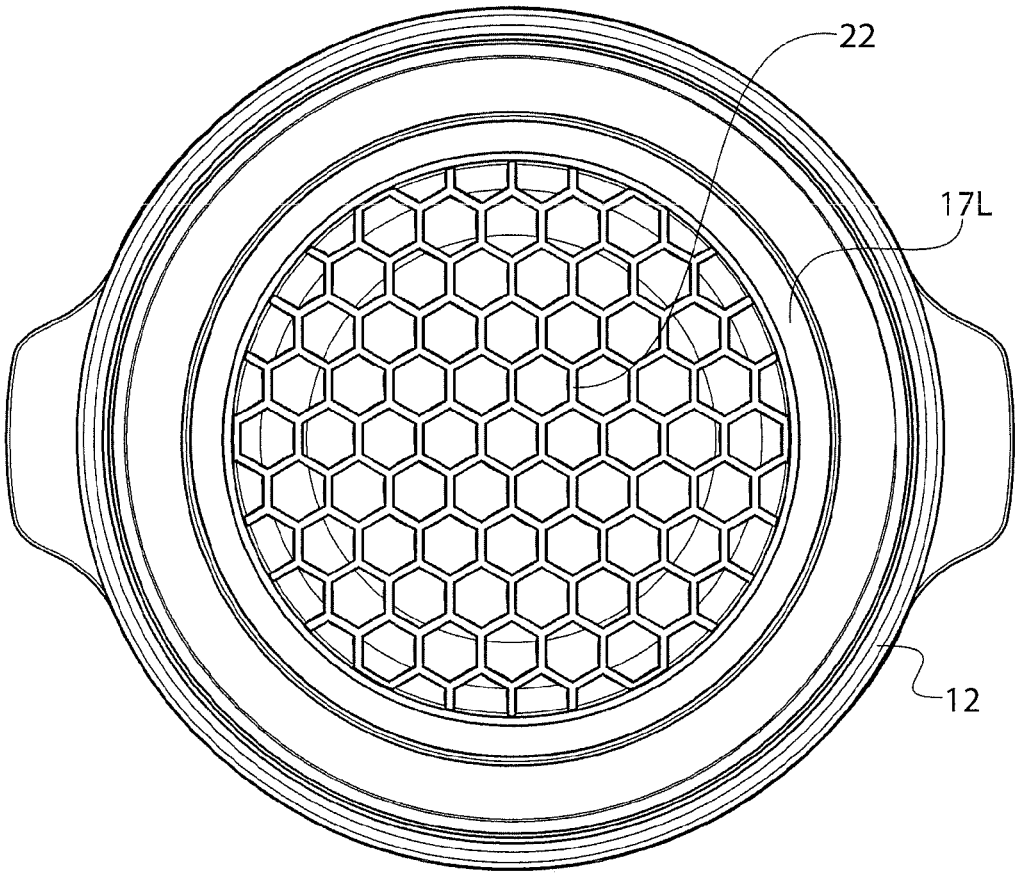
FIG. 5 is a bottom view of the collapsible container according to an implementation of the present principles.
Figure 6:
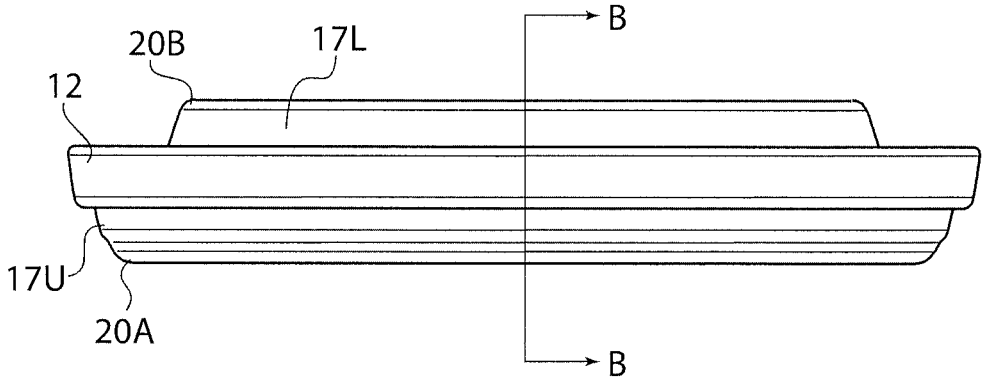
FIG. 6 is a side view of the collapsible container in the collapsed position according to an implementation of the present principles.
Figure 7:
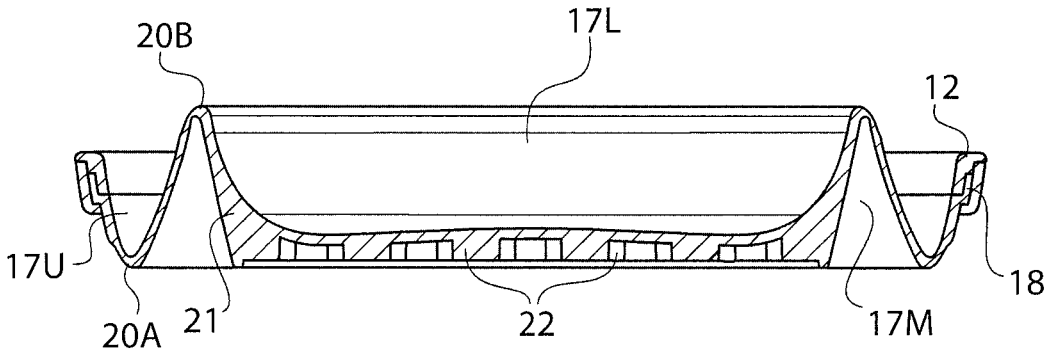
FIG. 7 is a cross-sectional view of the collapsed container of FIG. 6 taken along lines B-B, according to an implementation of the present principles.

In this implementation, the formation of a container 16 made entirely of the flexible material would, at first, seem inoperable, since the base would deform during the collapsing action. However, the present principles solve this problem by incorporating a structural ribbing 22 into the base 21. The structural ribbing is made of the same flexible material as the container 16, and operates to create stability in the same. Thus, when the top rim 12 is pushed downward to effect the collapsing action, the living hinges 20 flex and the entire container collapses to its storage position. The structural ribbing 22 prevents the base 21 from deforming during this collapsing motion. FIGS. 5-7 show these concepts and the structural ribbing 22 according to one implementation.

According to this implementation, the structural ribbing 22 is shown in a honeycomb configuration, which operates to increase the rigidity of the base 21, while allowing the entire container 16 to be manufactured from the same flexible material. The structural ribbing 22 can take other forms without departing from the scope of this disclosure. For example, the honeycomb style of the structural ribbing 22 shown could be implemented using different geometric shapes, such as circles, squares, triangles, etc.

Figure 4C:
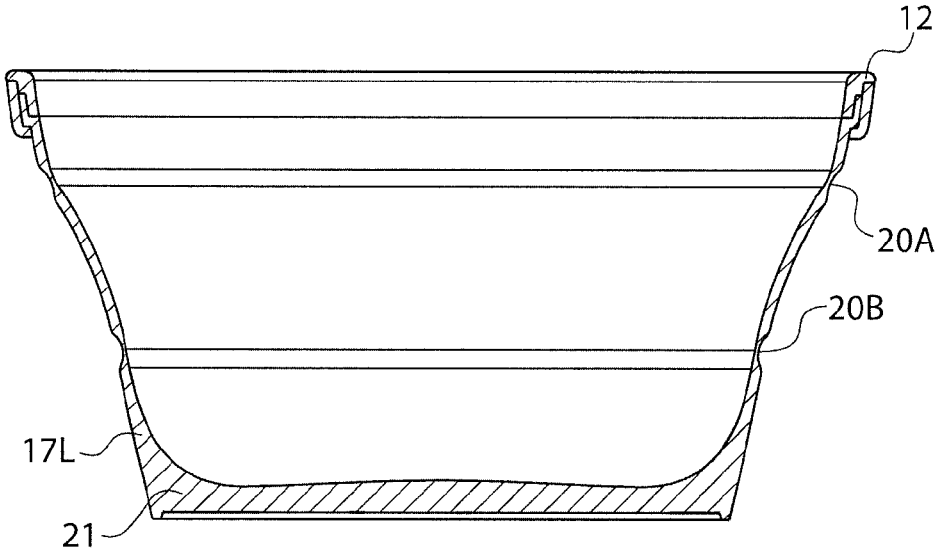
FIG. 4C is a cross-sectional view of the collapsible container according to yet another implementation of the present principles.

In accordance with another implementation shown in FIG. 4C, the structural ribbing 22 can be eliminated and the base 21 is formed entirely of the flexible material which is thicker than any connected side wall. In this manner, the base 21 maintains rigidity during use and would still allow the container (with base) to be formed from a single flexible material.

Those of skill in the art will appreciate that such improvement (i.e., the elimination of a rigid base) will reduce manufacturing costs and provide a unique and aesthetically attractive alternative to existing collapsible containers.

In accordance with other implementations, the flexible container 16 can contain one or more wire rings which could be added to add rigidity to the container, or could be added to add colors and/or any other non-functional design features to the collapsible container.

Although described generally in the context of the food industry, for which these concepts can be applied to, for example, bowls, strainers, measuring cups, sink strainers, funnels, and food storage container, the collapsible container of the present principles has applications outside the food industry. For example, a suitcase, an oil pan, small pools, or any other application where a container can be expended for use and subsequently collapsed for storage.

These and other features and advantages of the present principles may be readily ascertained by one of ordinary skill in the pertinent art based on the teachings herein. It is to be understood that the teachings of the present principles may be implemented in various forms of hardware, software, firmware, special purpose processors, or combinations thereof.

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. A collapsible container comprising:

a substantially rigid upper rim;

a flexible container made of a flexible material and having an upper opening for receiving said substantially rigid upper rim; said flexible container further comprising a base, side walls extending upward from said base and integrally formed therewith, and at least two living hinges separating said side walls into at least three sections, said base being thicker than the side walls, and being formed by the same flexible material as the side walls; and an outer ring configured to fit around the upper opening of the flexible container and engage the substantially rigid upper rim so as to mechanically secure the upper rim to the container.

2. The collapsible container of claim 1, wherein said base further comprises structural ribbing formed by the flexible material.

3. The collapsible container of claim 2, wherein said structural ribbing comprises a honeycomb configuration.

4. The collapsible container of claim 1, wherein two of said at least three sections are of equal height.

5. The collapsible container of claim 1, where each of said at least three sections are of unequal height.

6. The collapsible container of claim 1, wherein said rigid rim comprises at least one handle.

7. A collapsible container comprising:

an upper rim;

a flexible container made of a flexible material and having an upper opening for receiving said upper rim; said flexible container further comprising a base, side walls extending upward from said base, and at least one living hinge separating said side walls into at least two sections; and an outer ring configured to fit around the upper opening of the flexible container and engage the upper rim so as to mechanically secure the upper rim to the flexible container.

8. The collapsible container of claim 7, wherein said base is thicker than the side walls, and is formed by the same flexible material as the side walls.

9. The collapsible container of claim 8, wherein said base further comprises structural ribbing formed by the flexible material.

10. The collapsible container of claim 9, wherein said structural ribbing comprises a honeycomb configuration.

11. The collapsible container of claim 7, wherein said at least two sections are of equal height.

12. The collapsible container of claim 7, where each of said at least two sections are of unequal height.

13. The collapsible container of claim 7, wherein said upper rim comprises at least one handle.

14. The collapsible container of claim 7, wherein the side walls of the flexible container further comprise at least two living hinges separating the side walls into at least three sections.

15. The collapsible container of claim 14, wherein two of said at least three sections are of equal height.

16. The collapsible container of claim 14, wherein each of said at least three sections are of unequal height.

* * * * *